US006717505B1

(12) United States Patent
Bruchmann

(10) Patent No.: US 6,717,505 B1
(45) Date of Patent: Apr. 6, 2004

(54) CIRCUIT PROTECTION UNIT WITH FUSE CARRIER AND FUSE STATUS INDICATOR

(76) Inventor: Klaus Bruchmann, Am Oelberg 7a, D-96450 Coburg (DE)

( * ) Notice: Subject to any disclaimer, the term of this patent is extended or adjusted under 35 U.S.C. 154(b) by 0 days.

(21) Appl. No.: 10/130,911

(22) PCT Filed: Nov. 8, 2000

(86) PCT No.: PCT/EP00/11041

§ 371 (c)(1),
(2), (4) Date: Aug. 19, 2002

(87) PCT Pub. No.: WO01/39233

PCT Pub. Date: May 31, 2001

(30) Foreign Application Priority Data

Nov. 23, 1999 (DE) ..... 199 56 295
Nov. 23, 1999 (DE) ..... 299 20 554 U

(51) Int. Cl.[7] ..... H01H 81/50; H01H 85/32

(52) U.S. Cl. ..... 337/194; 337/187; 337/242; 361/104; 361/626

(58) Field of Search ..... 337/1, 4, 5, 9, 337/142, 186, 187, 194, 208, 241, 242, 245, 265, 266, 206; 361/104, 642, 646, 626, 833, 835, 837

(56) References Cited

U.S. PATENT DOCUMENTS 1,966,716 A * 7/1934 Green ..... 337/194
3,379,842 A * 4/1968 Downs et al. ..... 337/146

(List continued on next page.)

FOREIGN PATENT DOCUMENTS

DE 2754195 A * 6/1978 ..... E05C/15/04
DE 29 52 132 6/1981
DE 29714134 U1 * 10/1997 ..... H01H/9/22
DE 19734233 A1 * 2/1999 ..... H01H/85/25
DE 198 00 779 A1 7/1999
DE 19937017 C1 * 3/2001 ..... H01H/9/10
SE 482 288 1/1970

OTHER PUBLICATIONS

International Search Report of corresponding International Application PCT/EP00/11041.

(List continued on next page.)

*Primary Examiner*—Anatoly Vortman
(74) *Attorney, Agent, or Firm*—Wood, Phillips, Katz, Clark & Mortimer

(57) ABSTRACT

A fused switch unit is provided with two connecting contacts into which a fuse holder (20) can be inserted in order to hold a fuse link (30) with a head contact (31) and a foot contact (32). A first connecting contact (60) of the fused switch unit (10) can be connected via a controllable interruption contact (80) and by means of a bridging element (81) to a first of the contacts (31) of the fuse link (30). The fuse holder (20) or the fused switch unit (10) has a fuse state indicating device (40) with two contacts (42, 43) for an electrical connection for the connecting contacts (60, 70) of the fused switch unit (15). A first contact (42) of the fuse state indicating device (40) can be connected via an electrically conductive connection (91, 92, 82) directly and exclusively to the bridging element (81), and a second contact (42) of the fuse state indicating device (40) can be connected directly via an electrically conductive connection (50, 51, 52, 53, 71) to the second connecting contact (70) of the fused switch unit (10). This allows a high degree of flexibility for arrangement of the elements. Furthermore, it ensures a high level of operational reliability and safety, and little wear.

13 Claims, 5 Drawing Sheets

U.S. PATENT DOCUMENTS

| | | | | | |
|---|---|---|---|---|---|
| 3,599,135 | A | * | 8/1971 | Gryctko | 337/236 |
| 3,614,697 | A | * | 10/1971 | Dunham et al. | 337/6 |
| 3,732,516 | A | * | 5/1973 | Puetz | 337/194 |
| 3,936,787 | A | * | 2/1976 | Ranzanigo | 337/228 |
| 4,390,225 | A | * | 6/1983 | Coyne et al. | 439/332 |
| 4,488,767 | A | * | 12/1984 | Lehman et al. | 439/347 |
| 4,966,561 | A | * | 10/1990 | Norden | 439/622 |
| 5,355,274 | A | * | 10/1994 | Marach et al. | 361/104 |
| D367,041 | S | * | 2/1996 | Alfaro et al. | D13/160 |
| 5,559,662 | A | * | 9/1996 | Happ et al. | 361/104 |
| 5,594,404 | A | * | 1/1997 | Happ et al. | 337/210 |
| 5,726,852 | A | * | 3/1998 | Trifiletti et al. | 361/115 |
| 5,963,411 | A | * | 10/1999 | Mollet et al. | 361/104 |
| 6,373,370 | B1 | * | 4/2002 | Darr et al. | 337/243 |
| 6,472,878 | B1 | | 10/2002 | Bruchmann | |
| 6,531,948 | B1 | * | 3/2003 | Mennell | 337/211 |
| 6,566,996 | B1 | * | 5/2003 | Douglass et al. | 337/243 |
| 6,587,028 | B2 | * | 7/2003 | Mollet et al. | 337/194 |

OTHER PUBLICATIONS

International Preliminary Examination Report (in German) of International Application PCT/EP00/11041.

U.S. patent application Ser. No. 09/600,097, filed Jul. 11, 2000.

U.S. patent application Ser. No. 10/031,830, filed May 8, 2002.

U.S. patent application Ser. No. 10/031,831, filed May 15, 2002.

U.S. patent application Ser. No. 10/031,941, filed May 13, 2002.

U.S. patent application Ser. No. 10/031,943, filed Apr. 29, 2002.

* cited by examiner

CIRCUIT PROTECTION UNIT WITH FUSE CARRIER AND FUSE STATUS INDICATOR

This application is an application filed under 35 U.S.C. Sec. 371 as a national stage of international application PCT/EP00/11041, which was filed on Nov. 8, 2000.

TECHNICAL FIELD

The invention relates to a fused switch unit having two connecting contacts into which a fuse holder can be inserted in order to hold a fuse link with a head contact and a foot contact, in which case a first connecting contact can be connected via a controllable interruption contact, which has a bridging element, to the foot contact or to the head contact of the fuse link. The fuse holder or the fused switch unit in this case has a fuse state indicating device for checking the fuse link which can be inserted into the fuse holder, or for checking the switching state.

BACKGROUND OF THE INVENTION

Fused switch units with a fuse holder for a fuse link are known in many different embodiments both for electrical protection in buildings and dwellings and for electrical protection of machines and production plant.

In order to monitor the state of the fuse link, or the switching state, it is advantageous to provide a fuse state indicating device for fused switch units such as these. Such state indicating devices produce a generally visual signal at least whenever the contact via the fuse link can no longer be produced when the fused switch unit is in a ready to operate state, since, for example, the conductive bridge in a fusible link has blown. The state indicating device should never emit a signal when the fused switch unit is in a ready to operate state and there are no defects in the fuse link.

Depending on the contact, it is possible to provide for the fuse state indicating device also to produce a signal when the fuse holder together with the fuse link is in a ready to operate position, but the fused switch unit is in a disconnected position, in which, for example, the contact is interrupted by a switch at a point within the fused switch unit.

Fused switch units and fuse holders are known with different types of contact for such a fuse state indicating device. For example, it is possible to fit a conductor for making contact with the state indicating device, together with the fusible conductor, in the fuse link itself. However, in particular, this has the disadvantage that it complicates the production and the matching of the fuse link, since the conductor for making contact with the fuse state indicating device occupies space which is normally intended for the quartz sand used for insulation of the fusible conductor. Furthermore, during operation, the fusible conductor produces heat, which can damage the conductor for making contact with the state indicating device.

A fuse holder with an integrated connecting line for a state indicating device is known from DE 198 00 779 A1. In this case, connecting lines which connect the fuse state indicating device directly to the head contact and the foot contact of the fuse link are provided in the fuse holder. In this refinement as well, there is a risk of the connecting lines, which are located in the vicinity of the foot contact in particular, being damaged if any switching arcs occur during switching processes. In addition, both the fuse state indicating device and all the connecting lines are located inside the fuse holder, so that this provides only a small amount of flexibility for the arrangement, in particular, of the visual indication of the fuse state indicating device.

SUMMARY OF THE INVENTION

One object of the present invention is to provide a fused switch unit with a fuse holder for holding a fuse link, which has a fuse state indicating device, and with a high degree of flexibility being provided for the arrangement of the elements of the fuse state indicating device and of the corresponding connecting lines, while at the same time ensuring a high level of operational reliability and safety, and little wear.

The object is achieved by a fused switch unit according to the invention. Claims 11 to 13 relate to a fused switch system which has at least two fused switch units according to the invention, as claimed in one of claims 1 to 10.

According to the invention, the object is achieved in that a first contact of the fuse state indicating device is connected via an electrically conductive connection and exclusively to the bridging element of the interruption contact of the fused switch unit, and a second contact of the fuse state indicating device is connected directly via an electrically conductive connection to the second connecting contact of the fused switch unit.

In this case, the first contact is preferably connected via a conductor to a physically fixed end of a spring apparatus, which preloads the bridging element, of the interruption contact, with the spring apparatus also being composed of conductive material.

This firstly allows a high degree of variability to be achieved in the arrangement of the fuse state indicating device and of the corresponding connecting lines, since all the elements can be provided both in the fuse holder and in the fused switch unit. In particular, the preferred visual indication of the fuse state indicating device can be positioned, depending on the configuration of the fused switch unit, such that it is easily visible from the outside, without increasing the structural complexity.

The connecting lines for the fuse state indicating device may be located at a distance from those areas in which heat is produced during operation or in which switching arcs can occur during switching processes.

It is furthermore also advantageous to provide the majority of the connecting lines in the fused switch unit, since this, as the major component, will generally be designed to have a longer life than the fuse holders or fuse links, which in some circumstances need to be replaced more frequently.

Flexible connecting lines to the fuse state indicating device for making contact between the bridging element at a fixed end of a spring apparatus which preloads the bridging element are, furthermore, avoided, thus considerably reducing the risk of fuse state indicating device malfunctions caused, in particular, by wear.

The fuse state indicating device preferably has a visual indication, which is advantageously provided within a housing of a fuse holder. The housing of the fuse holder may in this case be a half-housing, which essentially holds only the area of the head contact of a fuse, or may be a full housing, which holds the fuse link essentially completely and leaves free any access points for making contact with the fuse link. The housing of the fuse holder and, possibly, parts of the fused switch unit in this case have a window, so that the visual indication can be seen from the outside.

It is particularly advantageous to provide an optical waveguide, so that light from the visual indication can be passed on at easily visible points. Firstly, this makes it possible for the light which is produced by the visual indication to be passed on independently of the position of the visual indication to easily accessible and easily visible points on the fused switch unit or the fuse holder while, secondly, it is also possible, in addition to or instead of the externally visible visual indication, to pass on the light that it is produced by the visual indication to a light-sensitive sensor, for example a photo cell, in order to allow automatic monitoring and, possibly, control of the fused switch unit.

This is particularly advantageous when a system is formed from a number of fused switch units, so that this allows reliable monitoring, without any delay, of all the fused switch units and, possibly, automatic control of the entire system.

BRIEF DESCRIPTION OF THE DRAWINGS

The invention will be explained in more detail in the following text with reference to the schematic drawings of two embodiments, in which.

DETAILED DESCRIPTION OF THE PREFERRED EMBODIMENTS

Figure 1:
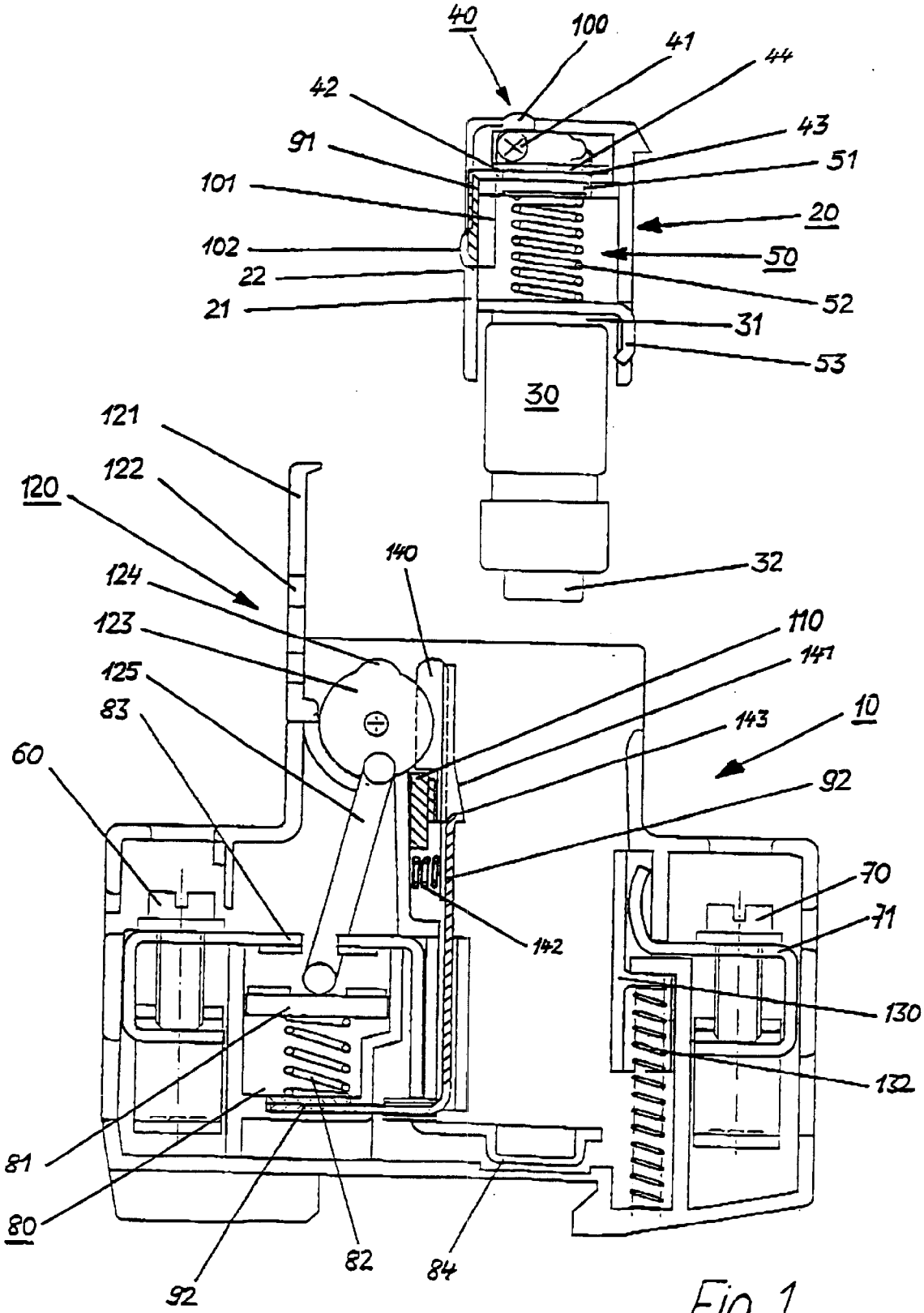
FIG. 1 shows a cross-sectional view of a first embodiment of the fused switch unit according to the invention, with a fuse holder which has been removed from the fused switch unit and has a fuse link.

FIG. 1 shows a first embodiment of a fused switch unit 10 according to the invention with two connecting contacts 60, 70 and with a fuse holder 20 together with a fuse link 30 having been removed from the fused switch unit 10. The connecting contacts 60, 70 of the fused switch unit 10 may be used differently, depending on the application, but it is preferable for the connecting contact 60 to be used as an input contact, while the connecting contact 70 is used as the output contact.

The connecting contact 60 is connected via an interrupted contact line 83 to a contact region 84 for a foot contact 32 of the fuse link 30.

A moving bridging element 81, which is preloaded by a spring 82, is used to bridge the interrupted contact line 83. The bridging element 81 is operated by a switch system 120. When the fused switch unit 10 is in the disconnected position shown in FIG. 1, a switching lever 121 is in an open position. The switching lever 121 is firmly connected to a cam disk 123, which can rotate. A switching bolt 125 is in turn mounted on this cam disk 123 and, when the bridging element 81 is in the disconnected position, presses downward against the spring force of the spring 82 in FIG. 1, so that the bridging element 81 is sufficiently far away from the contact line 83, and the contact line 83 is interrupted. There is thus no electrical connection between the connecting contact 60, which is used in this case as an input contact, and the contact region 84 for the foot contact 32 of the fuse link 30.

The connecting contact 70, which is used as an output contact, is connected to a contact line 71 for making contact with a contact element 53 of the fuse holder 20 for a head contact 31 of the fuse link 30.

The bridging element 81 is connected via the spring 82, which is composed of a conductive material, to a connecting line 92 for a fuse state indicating device 40. During insertion of the fuse holder 20 together with the fuse link 30 into the fused switch unit 10, the connecting line 92 makes contact with a connecting line 91 for the fuse state indicating device. The connecting line 91 for the fuse holder 20 is connected, at a first contact point 42, to a board 44 for controlling a light-emitting diode 41 in the fuse state indicating device 40.

A second contact point 43 connects the board 44 via a contact apparatus 50 (which comprises a connecting line 51, a spring 52 composed of conductive material and a contact element 53) and via the contact line 71 to the connecting contact 70, which is used as an output contact. The spring 52 is used, during insertion of the fuse holder 20, to reliably preload the fuse link 30 with pressure against the contact region 84 of the fused switch unit 10, thus ensuring a reliable contact.

A housing 21, which is in the form of a half-housing, for the fuse holder 20 has an opening above the light-emitting diode 41. A part of a waveguide 100 is fitted in this opening, so that light from the light-emitting diode 41 is visible from the outside through the waveguide 100, which is fitted in the region of the opening in the housing 21, and through an opening 122 in the switching lever 121 of the fused switch unit 10.

The waveguide 100 which is fitted in the opening extends via a waveguide conductor 101 to a second side opening in the housing 21 of the fuse holder 20, where it has a second indicator region 102, through which a proportion of the light emitted by the light-emitting diode 41 is likewise emitted. The light which is emitted from the indicator region 102 of the waveguide 100 can be detected, when a fuse holder 20 is inserted, by a photo cell 110 in the fused switch unit 10, in order, for example, to trigger an additional indication, possibly an audible indication, or else in order to control the fused switch unit 10 or a system comprising a number of fused switch units 10 via a control system.

Figure 5:
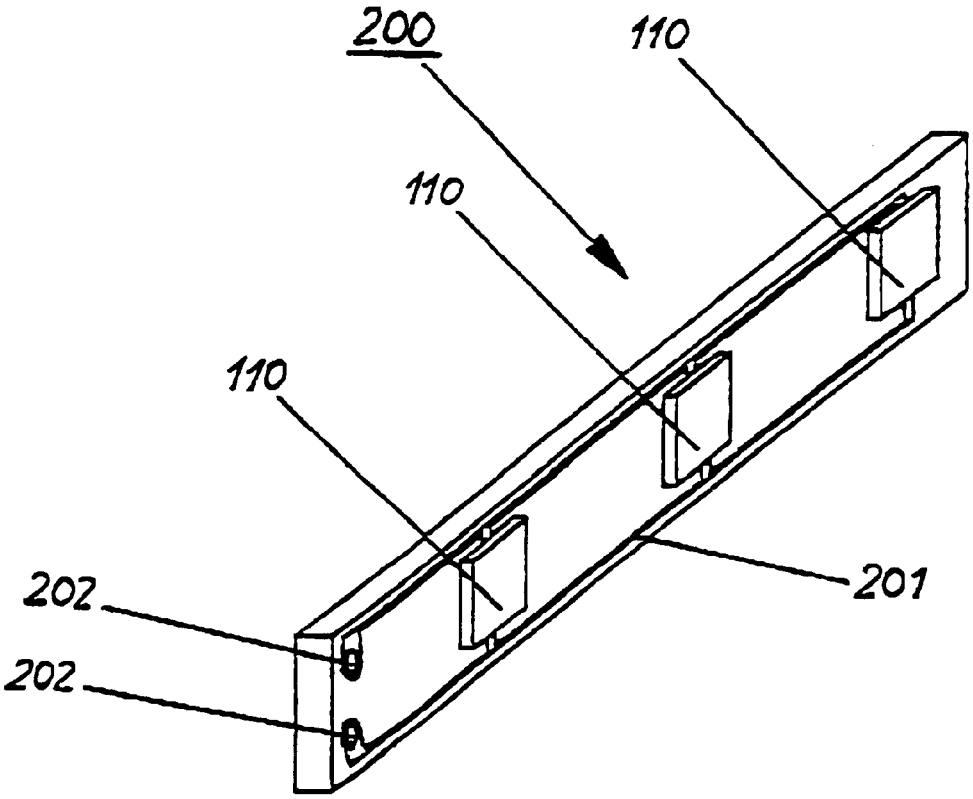
FIG. 5 shows a photo cell monitoring strip for monitoring three fused switch units according to the invention.

In the case of an overall system comprising a number of fused switch units 10, the photo cell 110 can also be inserted into a monitoring strip 200, which is shown in FIG. 5, having a number of photo cells 110 for monitoring the individual fused switch units 10 included in the overall system. It is thus possible to carry out a logic operation on all the photo cells 110 that are included in the monitoring strip 200 to ensure an automatic indication, or else automatic control, of the entire system or of individual fused switch units 10.

Figure 2:
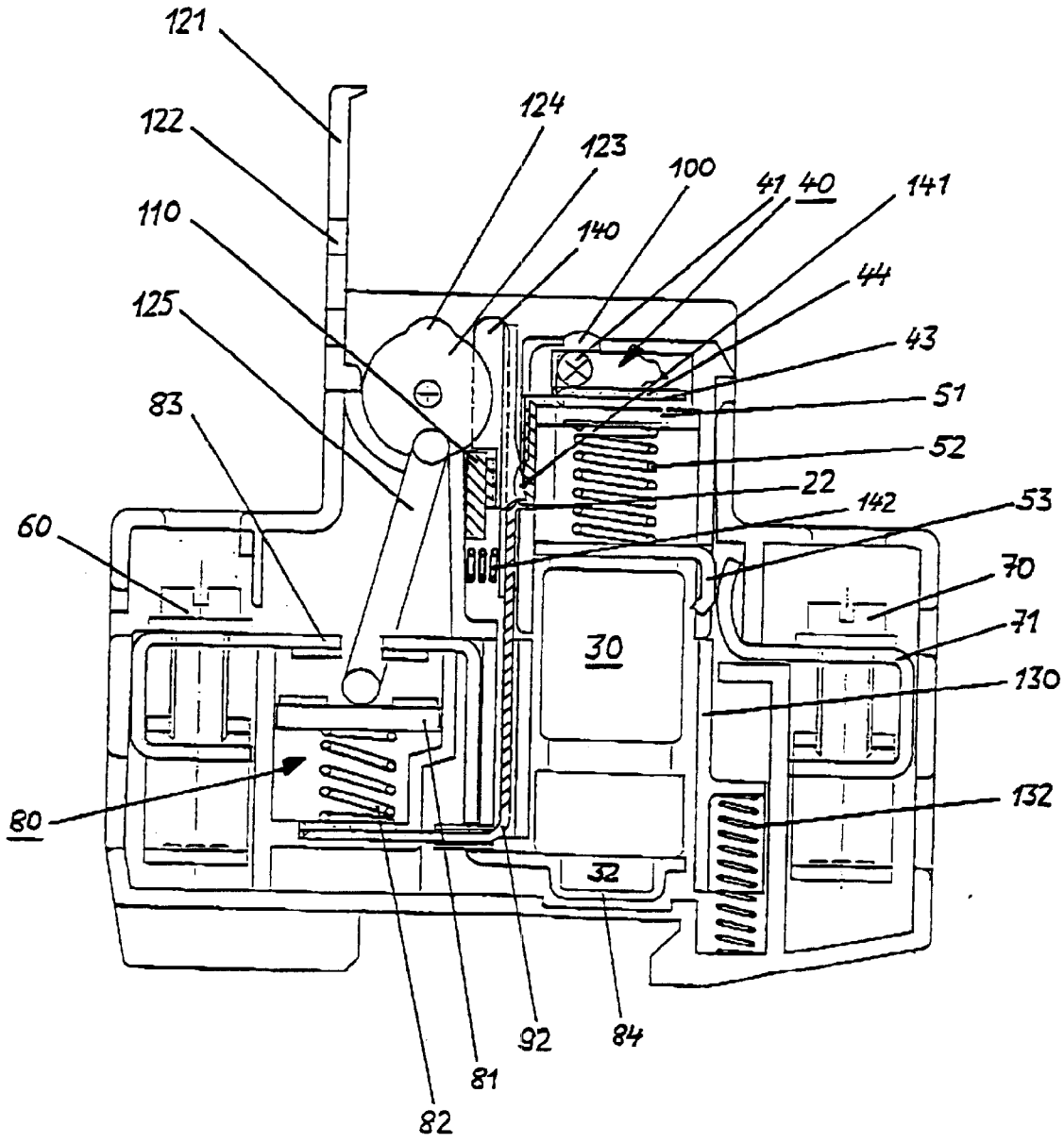
FIG. 2 shows the fused switch unit illustrated in FIG. 1, after the fuse holder together with the fuse link has been inserted.

FIG. 2 shows the embodiment of the fused switch unit 10 which is illustrated in FIG. 1, and into which the embodiment of the fuse holder 20 (which is likewise illustrated in FIG. 1) together with the fuse link 30 has been inserted in the region of the fused switch unit 10 provided for this purpose. During insertion of the fuse holder 20, a part of the housing 21 makes contact with an ejection element 130 of the fused switch unit 10 which, as the fuse holder 20 is inserted further, is displaced downward against an ejection spring 132 in FIG. 2.

During insertion, a part of the housing 21 of the fuse holder 20 likewise interacts with an incline 141 of a locking element 140 of the fused switch unit. In this case, during insertion of the fuse holder 20, the locking element 140 is pressed to the left in FIG. 2 against a locking spring 142, until the fuse holder has been completely inserted. The spring effect of the locking spring 142 then results in a latching element 143 (FIG. 1) of the locking element 140, or the connecting line 92, part of which is in the form of a continuation of the incline 141 or of the latching element 143, of the fuse state indicating device 40 engaging in a latching groove 22 in the housing 21, so that the fuse holder 20, together with the fuse link 30, is held fixed in its inserted and locked position in the fused switch unit.

The fuse holder 20 can be unlocked by manually compressing the locking element 140 against the spring force of the locking spring 142. After it has been unlocked, the fuse holder 20 is automatically ejected out of the fused switch unit 10 by the spring force of the ejection spring 132, via the ejection element 130.

The switching lever 121 of the fused switch unit 10 is still in its disconnected position, so that the bridging element 81 is pressed downward by the switching bolt 125 against the spring force of the spring 82, and the contact line 83 is interrupted between the contact region 84 for the foot contact and the connecting contact 60, which is used as an input contact. The board 44 is now connected to the bridging element 81 via the contact point 46, the connecting line 91, the connecting line 92 and the spring 82, although there is not yet any contact with the connecting contact 60, since the switch 121 is in the disconnected positions that have just been described.

On the other side, the board 44 is connected directly to the connecting contact 70, which is used as an output contact, via the second contact point 43, the connecting line 51, the spring 50, the contact element 53 and the contact line 71.

Figure 3:
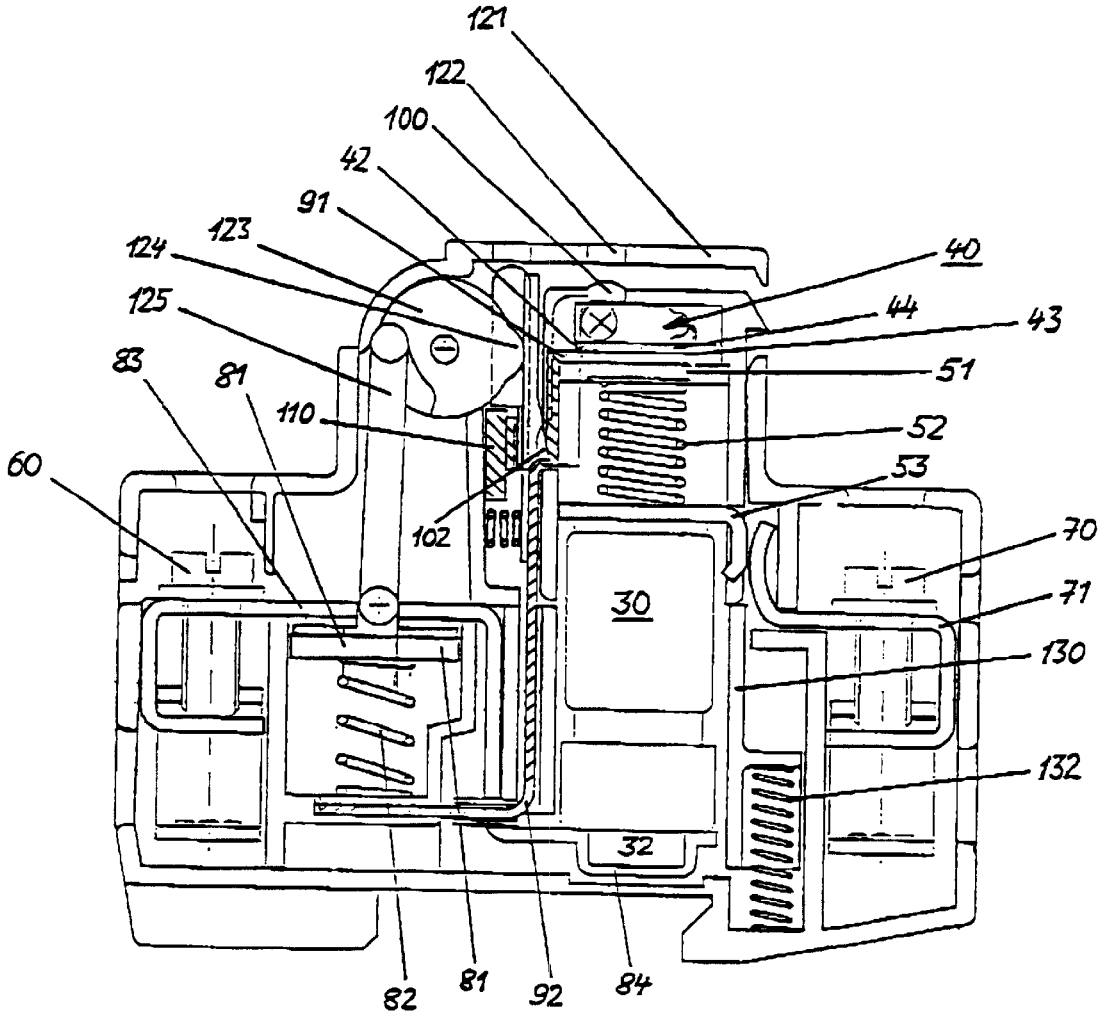
FIG. 3 shows the fused switch unit, as illustrated in FIGS. 1 and 2, in its operating state.

FIG. 3 shows the fused switch unit 10, with the switching lever 121 located in its connected position. Moving the switching lever 121 to its connected position, results in the cam disk 123, which is firmly connected to the switching lever 121, being rotated through 90° clockwise. The switching bolt 125, which is likewise connected to the cam disk 123, follows the movement of the cam disk 123, so that the bridging element 81 is pressed upward by the spring force of the spring 82 in FIG. 3, and bridges the contact line 83. The connecting contact 60 is thus connected to the foot contact 32 of the fuse link 30 via the contact line 83, the bridging element 81 and the contact region 84. The head contact 31 of the fuse link 30 is connected to the connecting contact 70 via the contact element 53 and the contact line 71, so that, with a serviceable fuse link 30, the fused switch unit is isolated, and a contact is made between the connecting contacts 60 and 70.

The board 44 of the fuse state indicating device 40 is now likewise connected to the connecting contact 60 via the first contact point 42, the connecting line 91, the connecting line 92, the spring 82, the bridging element 81 and the contact line 83.

If the fuse link 20 is serviceable, that is to say it has a low impedance, there is a short-circuit link between the connecting contacts 60 and 70, so that the two contact points 42 and 43 on the board 44 are at the same potential, as a result of which the light-emitting diode is not illuminated, via the controller for the board 44. If the fusible conductor (which is not shown) in the fuse link 30 now blows, then the short-circuit contact between the connecting contacts 60 and 70 is interrupted. The first contact point 42 is thus at the same potential as the connecting contact 60, while the contact point 43 is at the same potential as the connecting contact 70, so that the light-emitting diode 41 in the fuse state indicating device 40 is illuminated due to the potential difference between the two contact points 42 and 43.

The illumination of the light-emitting diode can be observed from the outside through the opening (which has already been described above) in the housing 21 of the fuse holder 20 and through the corresponding part of the waveguide 100 and through the opening 122 in the switching lever 121 of the fused switch unit 10. Furthermore, the illumination of the light-emitting diode is also passed on via the waveguide conductor 101 to the second indicator region 102, so that the photo cell 110 can detect the illumination of the light-emitting diode 41.

Figure 4:
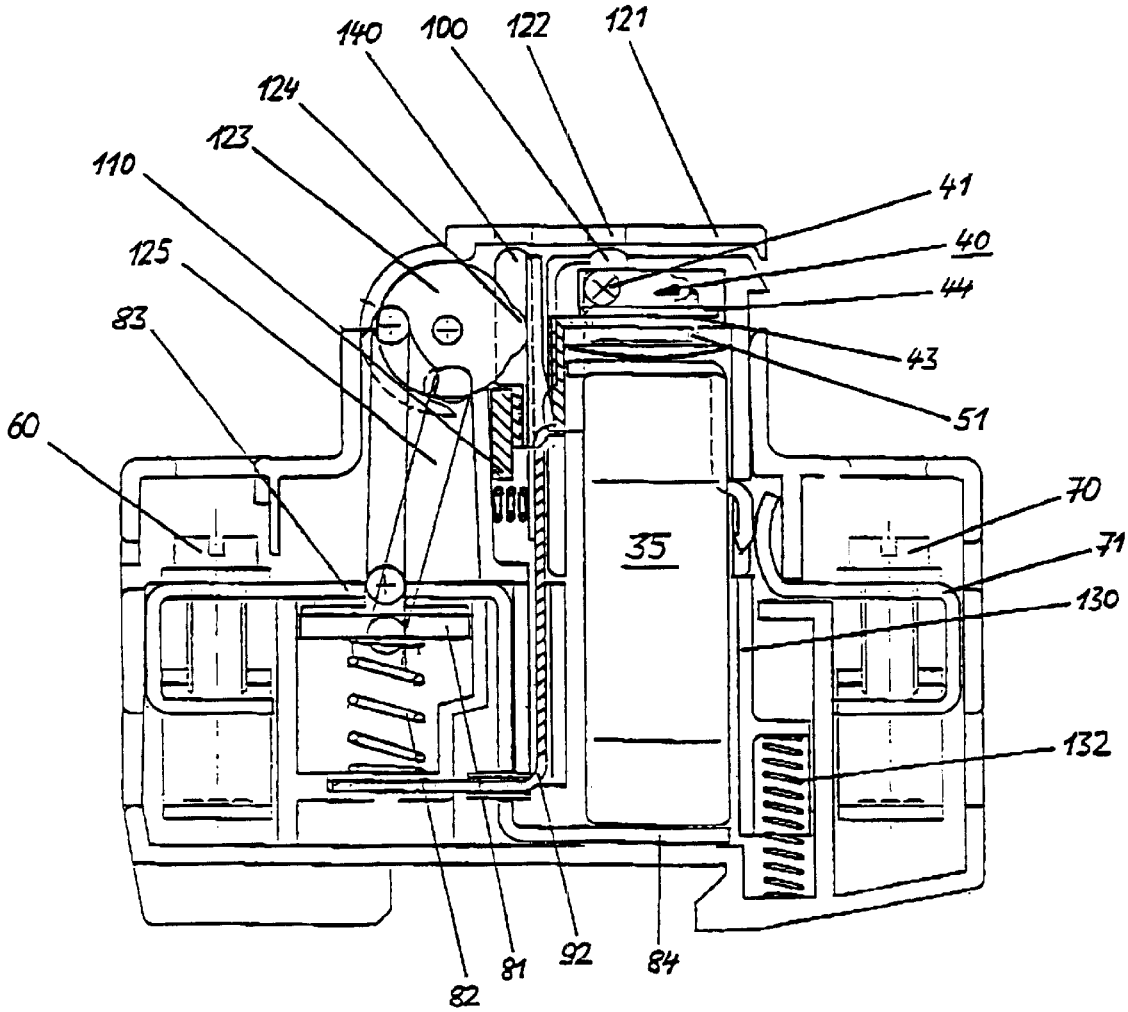
FIG. 4 shows a second embodiment of the fused switch unit according to the invention in its operating state.

In contrast to the embodiments of the fused switch unit 10 according to the invention as shown in FIGS. 1 to 3, which are designed for a fuse link 30 in accordance with the DIN Standard, FIG. 4 shows a second embodiment of a fused switch unit 10 according to the invention, which is designed for a fuse link 35 as is used in accordance with NFC in France. However, with regard to its functional features, this second embodiment corresponds exactly to the embodiment shown in FIGS. 1 to 3, so that it will not be described in detail once again. Identical or comparable components have been annotated with the same reference symbols.

FIG. 5 shows a monitoring strip 200 for three fused switch units 10. The monitoring strip 200 has three photo cells 110, which can be connected via connecting lines 201 and connecting contacts 202 to an external control apparatus in order, if necessary, to produce a further signal, for example an audible signal, or in order to control the fused switch unit, or the entire system, via a control apparatus. Known control apparatuses, logic circuits and computers can be used for this purpose.

The features which have been disclosed in the above description, the figures and the claims may be significant to the implementation of the invention both individually and in any desired combination.

List of reference symbols
B 20-35 DE

| | |
|---|---|
| 10 | Fused switch unit |
| 20 | Fuse holder |
| 21 | Housing (fuse holder) |
| 22 | Latching groove |
| 30 | Fuse link |
| 31 | Head contact |
| 32 | Foot contact |
| 35 | Fuse link |
| 40 | Fuse state indicating device |
| 41 | Light-emitting diode |
| 42 | First contact (fuse state indicating device) |
| 43 | Second contact (fuse state indicating device) |
| 44 | Board |
| 50 | Contact apparatus |
| 51 | Connecting line |
| 52 | Spring |
| 53 | Contact element |
| 60 | Connecting contact |
| 70 | Connecting contact |
| 71 | Contact line |
| 80 | Interruption contact |
| 81 | Bridging element |
| 82 | Spring apparatus |
| 83 | Contact line |
| 84 | Contact region (foot contact) |
| 91 | Connecting line |
| 92 | Connecting line |
| 100 | Optical waveguide |
| 101 | Optical waveguide conductor |
| 102 | Indicator region |
| 110 | Photo cell |
| 120 | Switch system |
| 121 | Switching lever |
| 122 | Opening |
| 123 | Cam disk |

-continued

| List of reference symbols B 20-35 DE | |
|---|---|
| 124 | Projection |
| 125 | Switching bolt |
| 130 | Ejection element |
| 132 | Ejection spring |
| 140 | Locking element |
| 141 | Incline |
| 142 | Locking spring |
| 143 | Latching element |
| 200 | Monitoring strip |
| 201 | Connecting line |
| 202 | Connecting contacts |

What is claimed is:

1. A fused switch unit (10) having two connecting contacts (60, 70) into which a fuse holder (20) can be inserted in order to hold a fuse link (30, 35) with a head contact (31) and a foot contact (32), in which case a first connecting contact (60) of the fused switch unit (10) can be connected via a controllable interruption contact (80) and by means of a bridging element (81) to a first (31) of the contacts (31, 32) of the fuse link (30), and in which the fuse holder (20) or the fused switch unit (10) has a fuse state indicating device (40) with two contacts (42, 43) for an electrical connection for the connecting contacts (60, 70) of the fused switch unit (10), wherein a first contact (42) of the fuse state indicating device (40) can be connected via an electrically conductive connection (91, 92, 82) directly and exclusively to the bridging element (81), and a second contact (43) of the fuse state indicating device (40) can be connected directly via an electrically conductive connection (50, 51, 52, 53, 71) to the second connecting contact (70) of the fused switch unit (10).

2. The fused switch unit as claimed in claim 1, wherein the first contact (42) is connected via a conductor (91) to a physically fixed end of a spring apparatus (82), which preloads the bridging element (81), of the interruption contact (80, 81, 82), with the spring apparatus (82) being composed of conductive material.

3. The fused switch unit as claimed in claim 1, wherein the fuse state indicating device (40) has a visual indication (41).

4. The fused switch unit as claimed in claim 3, wherein the fuse state indicating device (40) has a light-emitting diode (41) and a board (44).

5. The fused switch unit as claimed in claim 3, wherein the visual indication (41) is located within a housing (21) of the fuse holder (20).

6. The fused switch unit as claimed in claim 5, wherein the visual indication (41) can be seen through a window (100), which is provided in the housing (21) of the fuse holder (20) and/or in the fused switch unit (10).

7. The fused switch unit as claimed in claim 6, wherein a light-sensitive sensor (110) is provided in order to monitor the state of the visual indication (41).

8. The fused switch unit as claimed in claim 7, wherein the light-sensitive sensor (110) is connected to a control apparatus for controlling the fused switch unit (10), or for controlling an entire system.

9. The fused switch unit as claimed in claim 7, wherein the visual indication (41) is optically connected via an optical waveguide (100, 101, 102) to the light-sensitive sensor (110).

10. The fused switch unit as claimed claim 9, wherein the window (100) in the fuse holder (20) and/or in the fused switch unit (10) comprises a part of the optical waveguide (100 101, 102).

11. A fused switch system, comprising at least two fused switch units (10) as claimed in claim 1.

12. The fused switch system as claimed in claim 11, wherein a monitoring strip (200), in each case having a light-sensitive sensor (110), is provided for each fused switch unit (10).

13. The fused switch system as claimed in claim 12, wherein the monitoring strip (200) is connected to a control apparatus for controlling the fused switch system.

* * * * *